US005934800A

United States Patent [19]

Bonacci

[11] Patent Number: 5,934,800

[45] Date of Patent: Aug. 10, 1999

[54] PORTABLE CEMENT MIXER AND METHOD

[76] Inventor: Anthony S. Bonacci, 217 Fifth Ave., West Mifflin, Pa. 15122

[21] Appl. No.: 09/118,719

[22] Filed: Jul. 17, 1998

[51] Int. Cl.[6] ..... B28C 5/18

[52] U.S. Cl. ..... 366/47; 366/57; 366/213; 366/228

[58] Field of Search ..... 366/2, 6, 45–48, 366/53–63, 92, 93, 185, 208, 209, 213, 214, 220, 225, 228, 232, 606

[56] References Cited

U.S. PATENT DOCUMENTS

| | | | |
|---|---|---|---|
| 2,945,682 | 7/1960 | Hollingsworth . | |
| 4,521,116 | 6/1985 | Adsit | 366/54 |
| 4,684,259 | 8/1987 | Rice et al. | 366/213 |
| 4,756,623 | 7/1988 | Bishop | 366/57 |
| 5,182,981 | 2/1993 | Wilcox | 366/227 |
| 5,302,017 | 4/1994 | Platek et al. | 366/57 |
| 5,403,086 | 4/1995 | Lindesay | 366/59 |
| 5,613,774 | 3/1997 | Chandra et al. | 366/228 |
| 5,651,613 | 7/1997 | Mays et al. | 366/227 |

FOREIGN PATENT DOCUMENTS

| | | | |
|---|---|---|---|
| 8802687 | 6/1990 | Netherlands | 366/54 |
| 2224219 | 5/1990 | United Kingdom | 366/54 |
| 2274404 | 7/1994 | United Kingdom | 366/45 |

*Primary Examiner*—Charles E. Cooley
*Attorney, Agent, or Firm*—Douglas G. Glantz

[57] ABSTRACT

A portable mixer and method include providing a support frame having wheels and an opposite handle, an outer drum having a rotational drive mounted on the support frame, a rotatable drum, and a removable mixing container held inside the rotatable drum. A pivot arm handle extends at least one meter from the outer drum center of gravity. At least two spaced apart top handles on the removable mixing container are positioned axially spaced apart from at least two spaced apart bottom grippers. A handle extends from the support frame a distance at least one meter from the wheels. A mixer blade promotes thorough mixing. A keyway groove secures the removable mixing container within the rotatable drum. The keyway groove also serves as the mixer blade. A sidewall key on the rotatable drum expands into and holds the removable mixing container. A lock-in insert on the rotatable drum expands into and holds the removable mixing container.

20 Claims, 5 Drawing Sheets

PORTABLE CEMENT MIXER AND METHOD

BACKGROUND OF THE INVENTION

FIELD OF THE INVENTION

This invention relates to a mixer and method of making a mixture of cement, plaster, or the like. In one aspect, this invention relates to a novel portable mixer and method. In one aspect, this invention relates to a mixer having a novel portable insert bucket and method.

BACKGROUND

Cement as used herein is a general term referring to mixtures of limestone, cement, sand, mortar, plaster, or the like which are mixed with water to form building materials. The limestone, cement, sand, mortar, plaster, or the like can be mixed using shovels or spades on a flat ground surface. Enough water is added and then mixed with a pile of the limestone, cement, sand, mortar, plaster, or the like to make it smooth and plastic.

A garden hoe can mix limestone, cement, sand, mortar, plaster, or the like in small batches in a mortar box or a clean metal wheelbarrow.

These fundamental methods for mixing the cement usually are employed with a premix, e.g., such as cement premix, which only needs water to be added. However, these fundamental methods also can be used for mixing the cement from scratch.

Cement or mortar mixed from scratch typically uses Portland cement, sand, water, and sometimes lime or aggregates, such as gravel. These mixtures are more difficult and time consuming to produce. In these cases, a mechanical cement mixer often is used to make the mixing of the cement or plaster more efficient and less toil.

INTRODUCTION TO THE INVENTION

Standard mechanical cement mixers or plaster mixers are difficult to move and maneuver.

Even after the cement or plaster is mixed, the cement or plaster is difficult to move from the mechanical mixer to the point of use.

Mechanical mixers also are difficult to clean thoroughly after mixing cement. Moreover, in the event a mechanical mixer is not cleaned promptly after use, it is difficult and sometimes impossible to clean after the concrete or plaster has become hardened in the mechanical mixer. If the mechanical mixer is not cleaned thoroughly after use, the hardened material will build up and accumulate within the drum of the mixer and will contaminate subsequent mixtures. In some cases, the hardened material will damage or destroy a mixer which is not cleaned promptly and properly after use.

U.S. Pat. No. 4,521,116 discloses a container placed within a rotating drum for the purpose of mixing cement and then is removed to the site for use.

U.S. Pat. No. 4,684,259 discloses a small container placed within a rotator for mixing the ingredients therein and then is removed.

U.S. Pat. Nos. 5,182,981, 2,945,682, 5,302,017 and 5,613,774 disclose placing containers within rotators for mixing.

A cement mixer and method are needed which will provide a means and method for carrying mixed cement more easily to the point of use.

A general object of this invention is to provide a cement mixer and method for carrying mixed cement more easily to the point of use.

It is a more specific object of the present invention to provide a cement mixer and method for moving the cement mixer more easily.

Another object of the present invention is to provide a cement mixer and method providing means and method for cleaning the cement mixer more easily after use and before reuse.

These and other objects and advantages of the present invention will become more apparent to those skilled in the art in view of the following detailed description and the accompanying drawings.

SUMMARY OF THE INVENTION

A portable cement mixer and method of the present invention for mixing cement provide a support frame having wheels and an opposite handle, an outer drum having a rotational drive means mounted on the support frame, a rotatable drum, and a removable container held inside the rotatable drum. The drive means rotates the rotatable drum and removable container relative to the outer drum. The outer drum does not rotate about its longitudinal axis but is tilted about a transverse axis thereof via a pivot handle. A pivot arm handle extends at least one meter from the drum center of gravity. At least two spaced apart top handles on the removable container are positioned axially spaced apart from at least two spaced apart bottom grippers. A handle extends from the support frame a distance at least one meter from the wheels. A mixer blade promotes thorough mixing. A keyway groove secures the removable container within the rotatable drum. In one aspect, the keyway groove also serves as the mixer blade. In one aspect, a sidewall key on the rotatable drum expands into and holds the removable container. In another aspect, a lock-in insert on the rotatable drum expands into and holds the removable container.

DETAILED DESCRIPTION OF THE PREFERRED EMBODIMENTS

Figure 1:
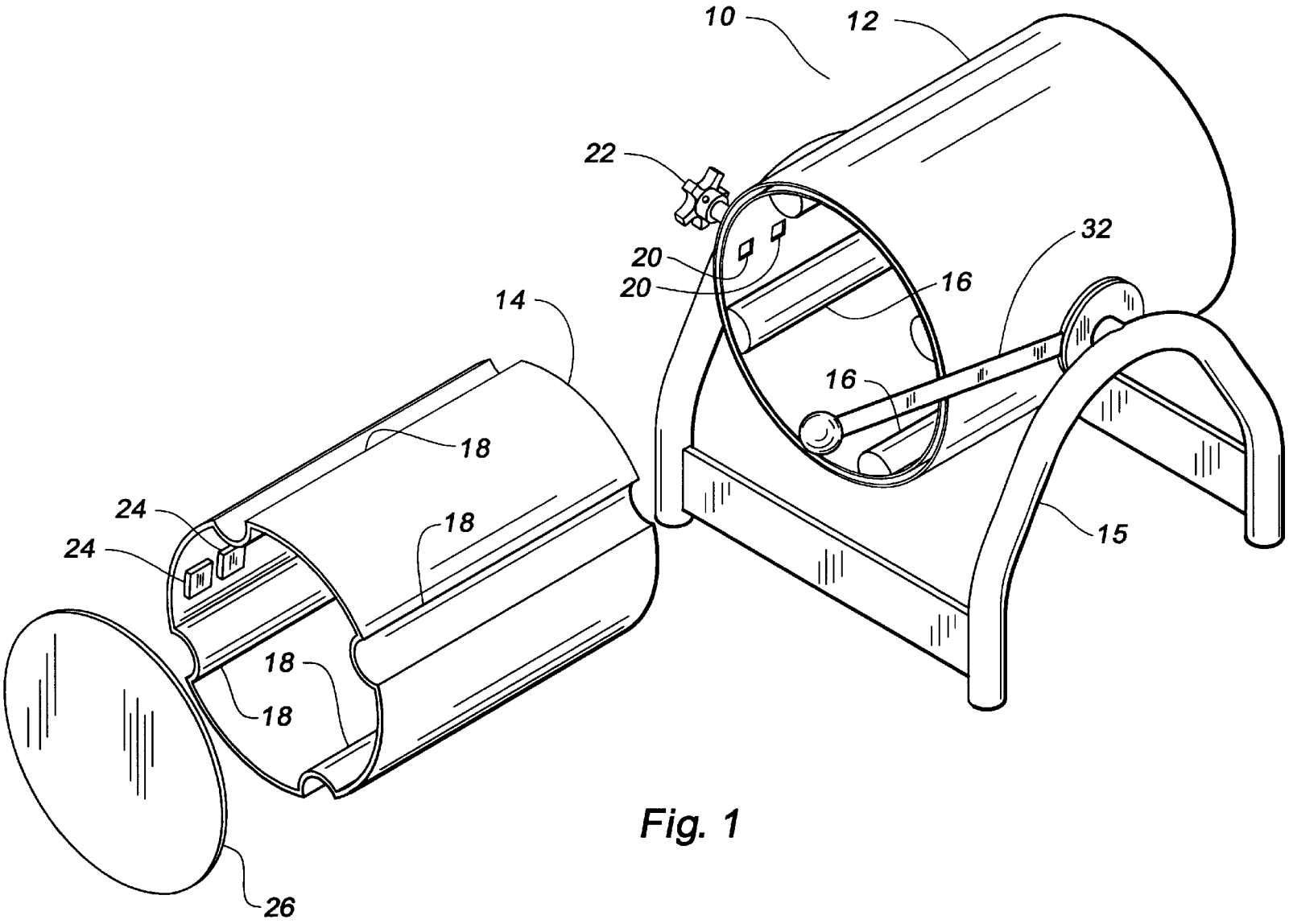
FIG. 1 is a perspective view of a cement mixer and portable insert bucket of the present invention.

Referring now to FIG. 1, a mixer 10, e.g., such as a cement mixer 10, has an outer mixer drum/housing 12 and an insert bucket 14. The outer mixer drum/housing 12 is secured on a support frame 15 for tilting movement about a transverse axis thereof. The insert bucket 14 preferably is a 10 gallon plastic bucket, although other sizes can be used. It has been found that a 10 gallon plastic bucket works well to handle one sack of eighty pounds of cement or concrete premix. The insert bucket is inserted into the outer mixer drum/housing 12 to be secured in the mixer 10 for mixing cement, plaster, mortar, or the like. After mixing the cement or concrete, plaster, mortar, or the like, the portable bucket 14 can be withdrawn from the mixer drum/housing 12 for carrying the cement mixture or the like to the point of use. The portable insert bucket 14 is cleaned easily before reuse.

The insert bucket 14 is held in rotatable drum/housing 30 (FIG. 2) by a plurality of spaced apart elongated steel half-round-rod holders 16 (FIG. 1) to secure the insert bucket 14 by engaging a plurality of keyway-like insert bucket holding grooves 18. Preferably, four spaced apart elongated steel half-round-rod holders 16 are used to secure the insert bucket 14 by engaging four keyway-like insert bucket holding grooves 18. The grooves 18 also act as blades to promote thorough cement mixing.

A pair of transportation lock-in rubber inserts 20 are pressed against the insert bucket 14 by a screw-in driver handle 22 to push a pair of rubber inserts 20 into a pair of countersunk depressions 24 in insert bucket 14. When the transportation lock-in rubber inserts 20 are received in the countersunk depressions 24 in the insert bucket 14, the portable insert bucket 14 is held firmly in outer mixer drum/housing 12.

The insert bucket 14 optionally employs a lid 26.

A long pivot handle 32 provides leverage for tilting the outer drum 12 up and down.

Figure 2:
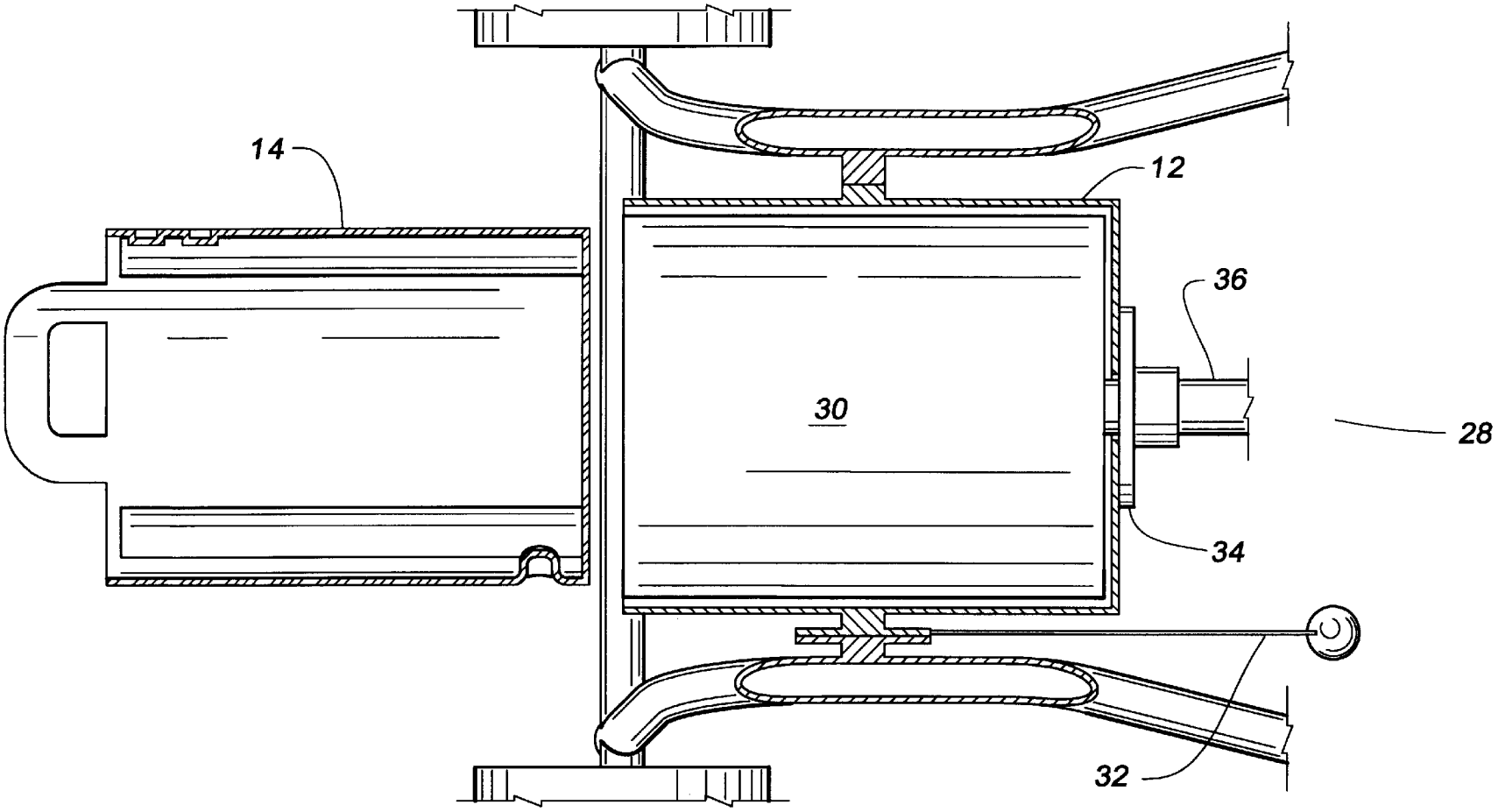
FIG. 2 is a top plan view, partially in section, of a cement mixer insert bucket and rotating drum assembly of the present invention.

Referring now to FIG. 2, the mixer 10, e.g., such as a cement mixer 10, has the outer mixer drum/housing 12 and a rotating drum mechanism 28 having a DRIVE MEANS 29 and a rotatable drum 30 for rotating insert bucket 14. The rotating drum mechanism 28 employs a bearing 34, a bearing 35, and a connecting rod or shaft 36 to connect rotatable drum 30 to a motor (not shown) of DRIVE MEANS 29. The outer mixer drum/housing 12 does not rotate about its longitudinal axis.

Figure 3:
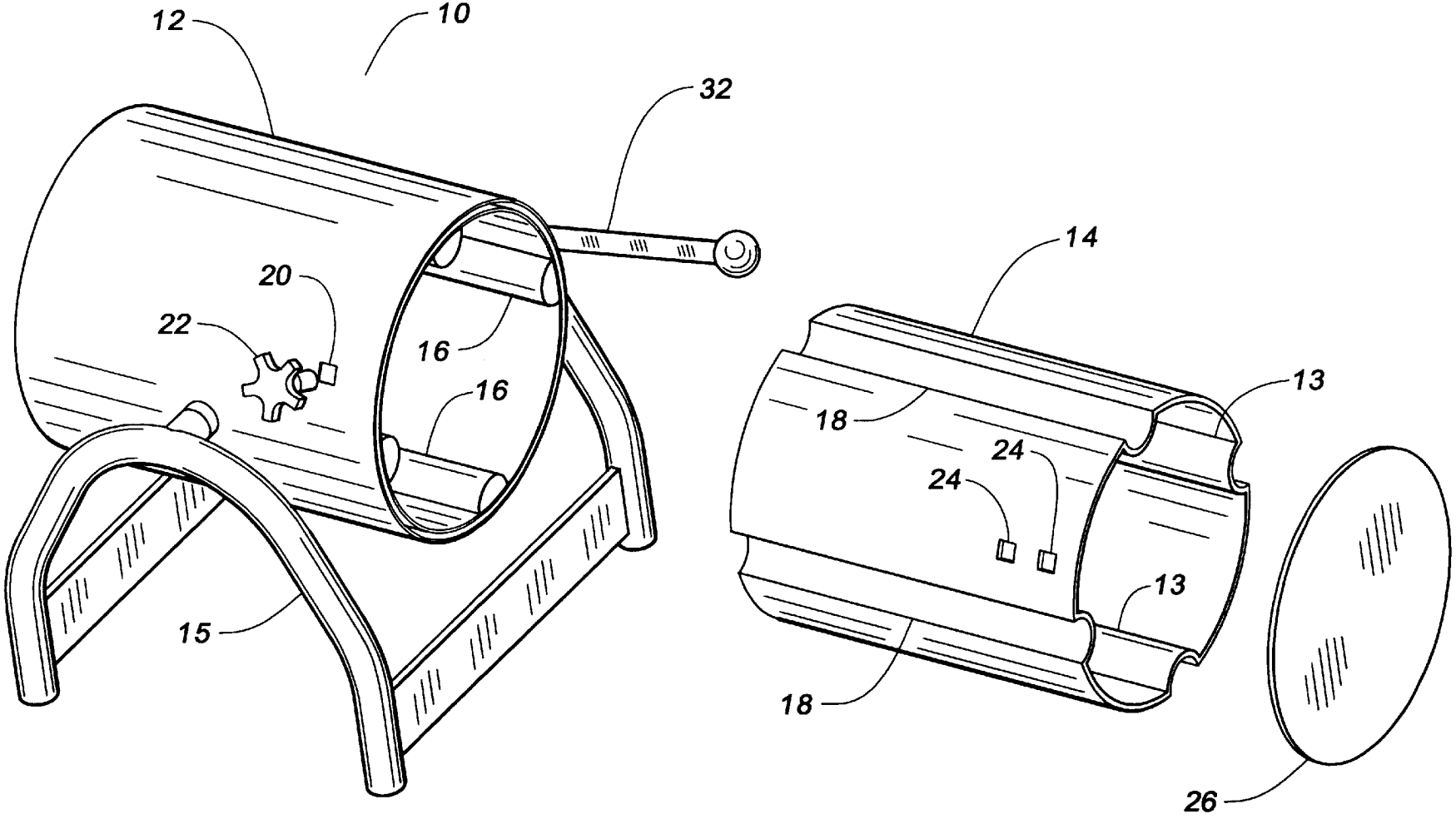
FIG. 3 is a perspective view of a cement mixer and portable insert bucket of the present invention from a side opposite to the view of FIG. 1.

Referring now to FIG. 3, a reverse angle perspective of mixer 10, e.g., such as a cement mixer 10, is shown.

Figure 4:
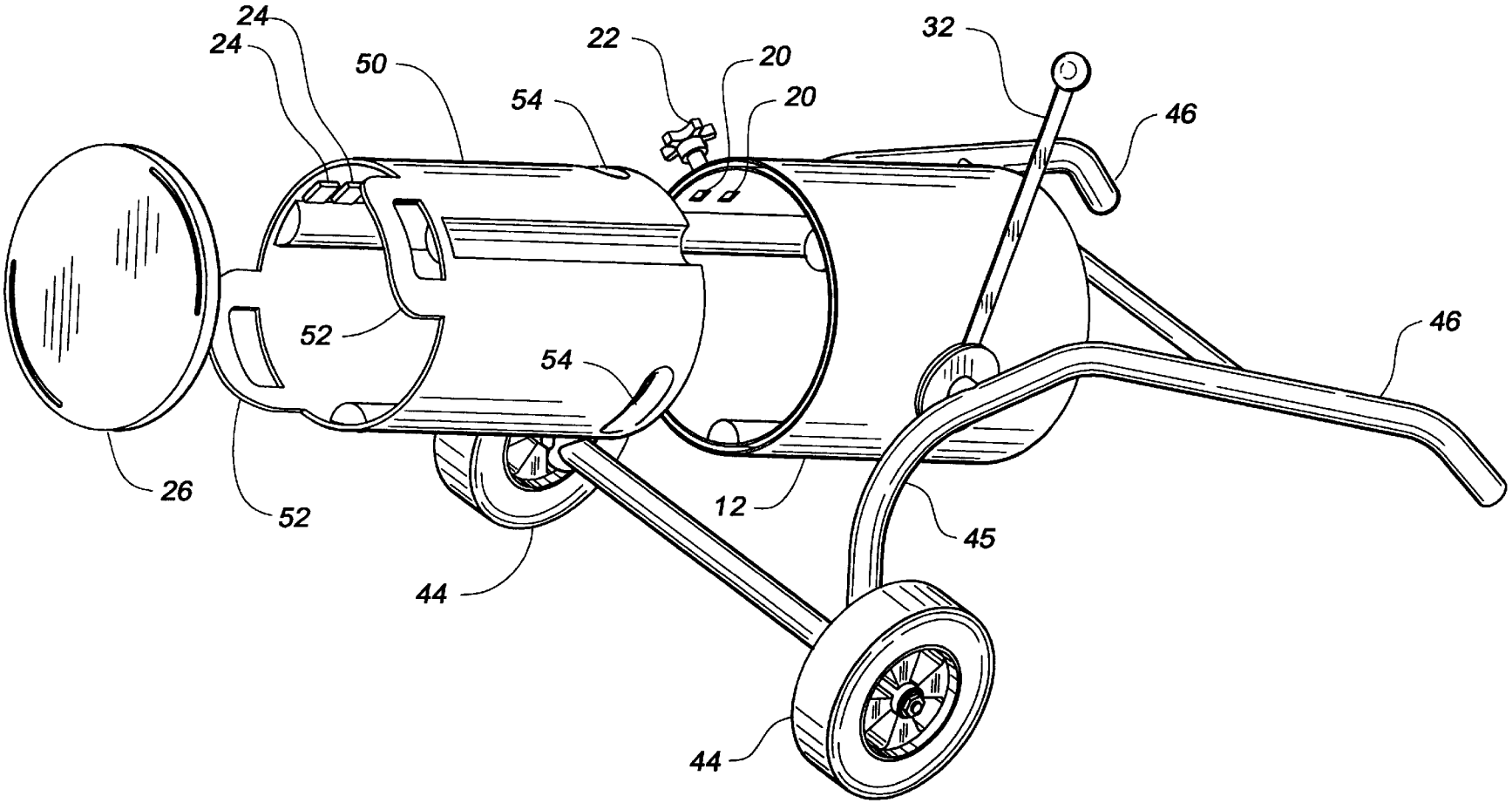
FIG. 4 is a perspective view of an alternative embodiment of a portable cement mixer and insert bucket of the present invention.

Referring now to FIG. 4, a portable mixer 40, e.g., such as a portable cement mixer 40, has a pair of wheels 44 provided on one end of a support frame 45 and a pair of elongated handles 46 on an opposite end of the support frame 45, i.e., opposite the wheels 44, to enable portable mixer 40, e.g., such as a portable cement mixer 40, to operate like a wheel barrow.

Insert bucket 50 has a pair of spaced apart handles 52 and a pair of gripper depressions 54 in the base of insert bucket 50 for hand gripping with a user/operator's opposite hand when pouring cement or plaster or the like. The gripper depressions 54 are positioned in the base of insert bucket 50 so as not to be aligned with handles 52 so that the cement or plaster or the like will pour without contacting the handle 52.

Figure 5:
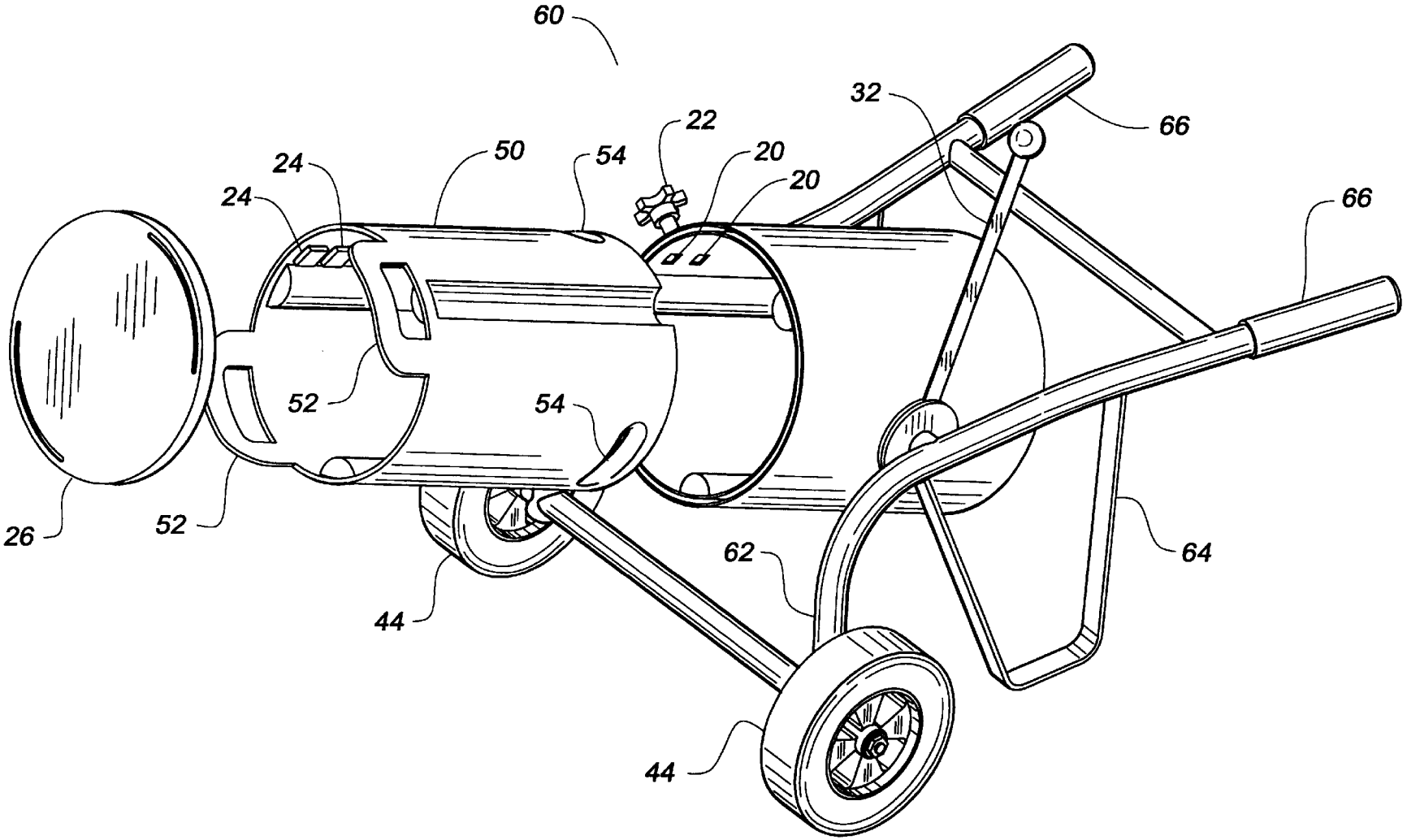
FIG. 5 is a perspective view of an alternative embodiment of a portable cement mixer and insert bucket of the present invention.

Referring now to FIG. 5, a portable mixer 60, e.g., such as a portable cement mixer 60, has a pair of wheels 44 provided on one end of a support frame 62 having a pair of support legs 64 and a pair of elongated handles 66 on an opposite end of the support frame 62, i.e., opposite the wheels 44, to enable the portable mixer 60, e.g., such as a portable cement mixer 60, to operate like a wheel barrow.

In a preferred embodiment, the portable cement mixer and method of the present invention for mixing cement or plaster or the like provide a support frame 45 or 62 having wheels 44 and an opposite handle 46 or 66 to operate like a wheel barrow. The handles 46 or 66 extend from the support frame 45 or 62, respectively, a distance of at least one meter from the wheels. In one embodiment, the handles 46 or 66 from the support frame 45 or 62, respectively, a distance of at least 1.5 meters from the wheels.

In a preferred embodiment, the outer drum 12 has a pivot arm handle 32 extending at least one meter from the drum center of gravity. In one embodiment, the outer drum 12 has a pivot arm handle 32 extending at least 1.5 meters from the drum center of gravity.

The two spaced apart top handles 52 on the removable container 50 are positioned axially spaced apart from the two spaced apart bottom grippers 54.

In a preferred embodiment, a mixer blade is used in the insert bucket 50 to promote thorough mixing. The keyway groove 18 secures the removable container 14 or 50 within the rotatable drum 30. In one aspect, the keyway groove 18 also serves as the mixer blade. In one aspect, the sidewall key 16 on the rotatable drum 30 expands into and holds the removable container 14 or 50. In another aspect, the transportation lock-in insert 20 expands into and holds the removable container 14 or 50 for securing the mixer 10 during moving or transportation of the mixer 10.

In an alternative embodiment, the spaced apart elongated steel half-round-rod holders 16 can be replaced by spring loaded expandable rubber holders to secure the insert bucket 14 by holding the insert bucket grooves 18. In an alternative embodiment, the spaced apart elongated steel half-round-rod holders 16 can be replaced by pipe-threader-type lock-in holders.

The portable, removable container 14 or 50 preferably is composed of a high density polyethylene. The sidewall key preferably is composed of a hard rubber.

In the event the cement mixer of the present invention is not cleaned thoroughly after use, such that the concrete becomes hardened in the mixer, the removable container 14 or 50 can be replaced without incurring the expense of repairing or replacing the rotatable drum 30.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

We claim:

1. A cement mixer, comprising:

(a) a support frame having wheels and an opposite handle;

(b) an outer drum mounted on said support frame, wherein said outer drum has a pivot arm handle extending at least one meter from a center of gravity of said outer drum;

(c) a rotatable drum mounted in said outer drum; and (d) a removable container adapted to be held inside said rotatable drum, wherein said removable container has at least two spaced apart top handles and at least two spaced apart bottom grippers, said bottom grippers having an axial position spaced apart from the axial position of said top handles.

2. The cement mixer of claim 1, wherein said support frame handle extends at least one meter from said wheels.

3. The cement mixer of claim 2, wherein said support frame handle comprises two handles extending at least 1.5 meters from said wheels.

4. The cement mixer of claim 1, wherein said outer drum pivot arm handle extends at least 1.5 meters from the center of gravity of said outer drum.

5. The cement mixer of claim 1, wherein said removable container has a mixer blade for promoting thorough mixing.

6. The cement mixer of claim 1, further comprising means for securing said removable container within said rotatable drum.

7. The cement mixer of claim 6, wherein said means for securing said removable container within said rotatable drum comprises a keyway groove in said removable container.

8. The cement mixer of claim 7, wherein said removable container has a mixer blade for promoting thorough mixing and said keyway groove comprises a portion of said mixer blade.

9. The cement mixer of claim 8, comprising a plurality of mixer blades.

10. The cement mixer of claim 8, comprising three or more mixer blades.

11. The cement mixer of claim 8, wherein said rotatable drum has a lock-in insert for expanding into and holding said removable container.

12. The cement mixer of claim 8, wherein said rotatable drum has a sidewall key for expanding into and holding said keyway groove.

13. The cement mixer of claim 12 wherein said sidewall key is composed of rubber.

14. The cement mixer of claim 8, wherein said removable container is composed of high density polyethylene.

15. A method of making a cement mixture comprising the steps of:

(a) providing a support frame having wheels and two handles opposite said wheels, wherein said handles extend at least one meter from said wheels;

(b) providing rotational drive means mounted on said support frame;

(c) providing a rotatable drum adapted to be held by said rotational drive means and a pivot handle extending at least one meter from a center of gravity of said rotatable drum; and (d) providing a removable container adapted to be held inside said rotatable drum, wherein said removable container has at least two spaced apart top handles and at least two spaced apart bottom grippers, said bottom grippers having an axial position spaced apart from an axial position of said top handles.

16. The method of making a cement mixture as set forth in claim 15, further comprising providing three or more mixer blades for promoting thorough mixing in said removable container.

17. The method of making a cement mixture as set forth in claim 15, further comprising providing a keyway groove in said removable container for securing said removable container within said rotatable drum and providing a sidewall key in said rotatable drum for expanding into and holding said keyway groove.

18. The method of making a cement mixture as set forth in claim 15, further comprising using said support frame as a portable cement mixer wheelbarrow.

19. The method of making a cement mixture as set forth in claim 18, providing a transportation lock-in insert on said rotatable drum for expanding into and holding said removable container.

20. A portable cement mixer, comprising:

(a) a support frame having wheels and two opposite handles extending at least one meter from said wheels;

(b) an outer drum having a rotational drive means mounted on said support frame, wherein said outer drum has a pivot arm handle extending at least one meter from a center of gravity of said outer drum;

(c) a rotatable drum adapted to be held by said rotational drive means;

(d) a removable mixing container composed of a high density polyethylene and adapted to be held inside said rotatable drum, wherein said removable mixing container has at least two spaced apart top handles and at least two spaced apart bottom grippers, said bottom grippers having an axial position spaced apart from the axial position of said top handles;

(e) three or more mixer blades in said removable mixing container for promoting thorough mixing;

(f) keyway groove means in said removable mixing container for securing said removable mixing container within said rotatable drum, wherein said keyway groove means comprises a portion of said mixer blades;

(g) a rubber sidewall key on said rotatable drum for expanding into and holding said keyway groove means in said removable mixing container; and (h) a transportation lock-in insert on said rotatable drum for expanding into and holding said removable mixing container.

* * * * *